United States Patent [19]

Simeth et al.

[11] 4,384,524

[45] May 24, 1983

[54] ARRANGEMENT FOR SPREADING SHEETS EVENLY ON IMPRESSION CYLINDER OF PRINTING PRESSES

[75] Inventors: Claus Simeth, Offenbach am Main; Peter Mayer, Muhlheim am Main, both of Fed. Rep. of Germany

[73] Assignee: M.A.N.-Roland Druckmaschinen Aktiengesellschaft, Fed. Rep. of Germany

[21] Appl. No.: 324,768

[22] Filed: Nov. 25, 1981

[30] Foreign Application Priority Data

Nov. 27, 1980 [DE] Fed. Rep. of Germany ..... 3044649

[51] Int. Cl.[3] ..... B41F 21/00; B41F 25/00

[52] U.S. Cl. ..... 101/232; 271/276

[58] Field of Search ..... 101/232, 419, 416 A, 101/216, 217, 183, 174, 132, 136, 137, 141, 142, 409, 246; 271/309, 194, 195, 276, 277; 34/23; 226/97, 95

[56] References Cited

U.S. PATENT DOCUMENTS

| | | | |
|---|---|---|---|
| 3,506,259 | 4/1970 | Caldwell et al. | 101/232 |
| 3,949,671 | 4/1976 | Madigan | 101/232 |
| 3,986,455 | 10/1976 | Jeschke | 271/276 |
| 4,099,463 | 7/1978 | Zimermann | 271/195 |

*Primary Examiner*—J. Reed Fisher

*Attorney, Agent, or Firm*—Leydig, Voit, Osann, Mayer & Holt, Ltd.

[57] ABSTRACT

A device for seating and spreading a conveyed sheet evenly on an impression cylinder of a printing press thereby to prevent fluttering which includes a pair of pipes arranged parallel to one another in axially extending position above the cylinder. The pipes are bridged by a top wall and end walls to enclose the space between them to form a plenum chamber adjacent the surface of the cylinder, the under surfaces of the pipes defining, with the surface of the cylinder, an air gap of constant width. The outer side walls of the pipes each have a flat upper portion and an inwardly curved lower portion smoothly continuous therewith, each flat upper portion having a skirt arranged parallel thereto in overlapping relation to define nozzles in the form of a narrow slit which extends continuously along each pipe and which is in communication therewith so that air supplied to the pipes under pressure is directed radially inward along and parallel to each side wall, the air being diverted by the Coanda effect inwardly into the air gaps for building up a pressure head in the chamber. Such pressure head presses upon and tends to spread a conveyed sheet evenly on the surface of the cylinder. The chamber is vented through a restriction to limit the pressure which is in the chamber and which is applied to the sheet.

6 Claims, 4 Drawing Figures

ARRANGEMENT FOR SPREADING SHEETS EVENLY ON IMPRESSION CYLINDER OF PRINTING PRESSES

In a sheet-fed lithographic press a sheet is conveyed on the impression cylinder by grippers which hold the sheet only along its leading edge. As a result, and due to the high speed of conveyance plus the action of centrifugal force, the body and tail-end of the sheet fly out of contact with the surface of the cylinder and are subject to severe fluttering, often resulting in tearing or defacement of the sheet.

This problem has been recognized for years and air jets have often been employed in an effort to keep the sheet seated on the surface of the impression cylinder as evidenced by German Patent Nos. 536,453 and 555,814 (1932). However, such efforts have been largely self-defeating since the swirling of the air from the air jet tends to lift the trailing edge of the sheet as the sheet leaves the region of the jet.

Consequently, consideration has been given to the use of mechanical hold-down arrangements including brushes riding in contact with the sheet as set forth, for example, in German Patent No. 193,368. However, because of mechanical contact there is risk of abrasion and tearing of the sheet.

Consequently resort has been had to various specialized arrangements usully involving control of the air surrounding the sheet as set forth, for example, in German patent application No. 2,754,082.

It is, accordingly, an object of the present invention to provide a device for seating and spreading a sheet conveyed on an impression cylinder of a printing press which employs pressurized air jets but in which the pressurized air is utilized in such a way as to avoid lifting the trailing edge of the sheet as the sheet passes by, as occurs in more conventional air jet arrrangements. It is a related object to provide a device for spreading a conveyed sheet on an impression cylinder which acts simultaneously over a large area of the sheet progressively from the leading to the trailing edges and which avoids creation of air currents which might tend to lift the trailing edge.

More specifically it is an object of the present invention to provide a speading, or hold-down, arrangement for a conveyed sheet in which a plenum chamber is provided adjacent the surface of the impression cylinder, with means for building up pressure in the chamber while avoiding outflow of air through the gap between the chamber and the surface of the impression cylinder. In short, it is an object to provide a plenum for seating and spreading a sheet in which the pressure is built up by air flowing inwardly into the chamber at the clearance gap rather than outwardly as might be expected.

In this connection it is an object of the invention to provide a device for seating and spreading a conveyed sheet which employs a pressurized plenum in which the pressure is obtained from air jets outside of the plenum utilizing the Coanda effect.

It is still another object of the present invention to provide a device for seating and spreading the conveyed sheet to prevent fluttering thereof through a cushion of air acting progressively along the length of the sheet and which therefore runs no risk whatsoever of tearing or defacing the sheet. It is yet another object of the invention to provide a device for seating and spreading a conveyed sheet which is sufficiently compact as to be applicable to all designs of sheet-fed presses, which is economical in its construction and in its use of air, and which is trouble-free requiring no care or maintenance, except for occasional cleaning, over the life span of the press.

Other objects and advantages of the invention will become apparent upon reading the attached detailed description and upon reference to the drawings in which.

While the invention has been described in connection with a preferred embodiment, it will be understood that there is no intention to limit the invention to the construction shown but we intend, on the contrary, to cover the various alternative and equivalent constructions included within the spirit and scope of the appended claims.

Figure 1:
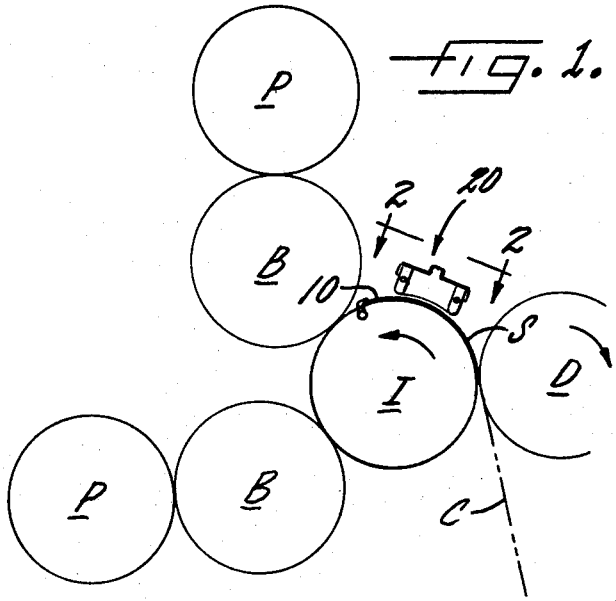
FIG. 1 is a diagram showing in elevation the cylinders of a typical lithograph press with the device embodying the present invention in section.

Turning now to FIG. 1 there is shown a typical arrangement of cylinders in a lithograph press including two plate cylinders P offsetting onto a pair of blanket cylinders B which cooperate with a single impression cylinder I carrying a sheet S to which the printed impressions are applied in succession. Sheets are conveyed seriatim to the impression cylinder by a conveyor chain C which is trained around a conveyor drum D. The leading edge 10 of the sheet is engaged by grippers 11 having means well known to those skilled in the art for opening and closing the grippers synchronously with the arrival of a sheet on the conveyor. The sheet, as shown in FIG. 3 somewhat foreshortened, has a body 12 and trailing edge 13.

In carrying out the present invention a seating and spreading device 20 is provided in the form of an elongated rectangular box having side walls, end walls and a top wall defining a plenum chamber. The box is mounted in axially extending position so that the lower edges of the side walls define with the surface of the cylinder an air gap of constant width. Nozzles in the form of a narrow slit extending continuously along the respective side walls, the side walls being curved mutually inwardly so that pressurized air discharged at the nozzles is diverted by the Coanda effect mutually inwardly into the gaps at the lower edges of the side walls for building up a pressure head in the chamber which presses upon and tends to spread a conveyed sheet evenly on the surface of the cylinder.

Figure 2:
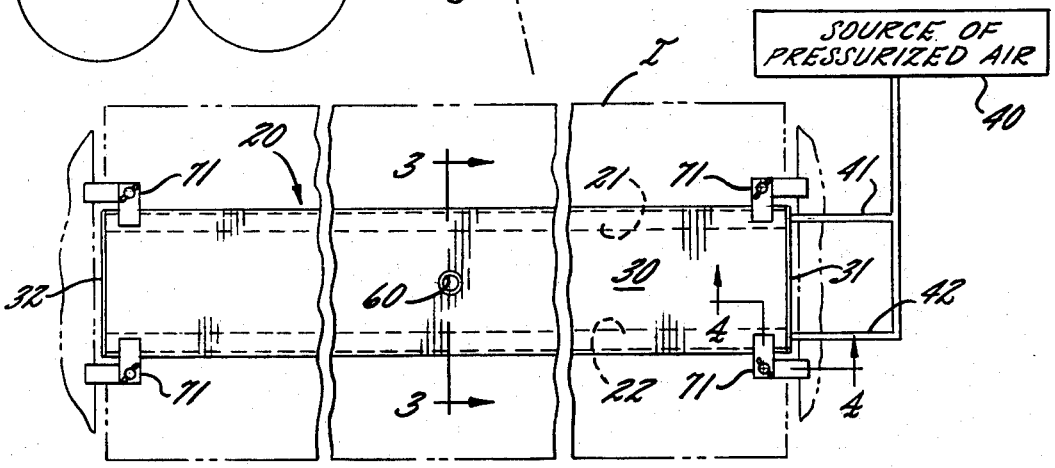
FIG. 2 is a foreshortened view of the inventive structure as viewed along line 2—2 in FIG. 1.
Figure 3:
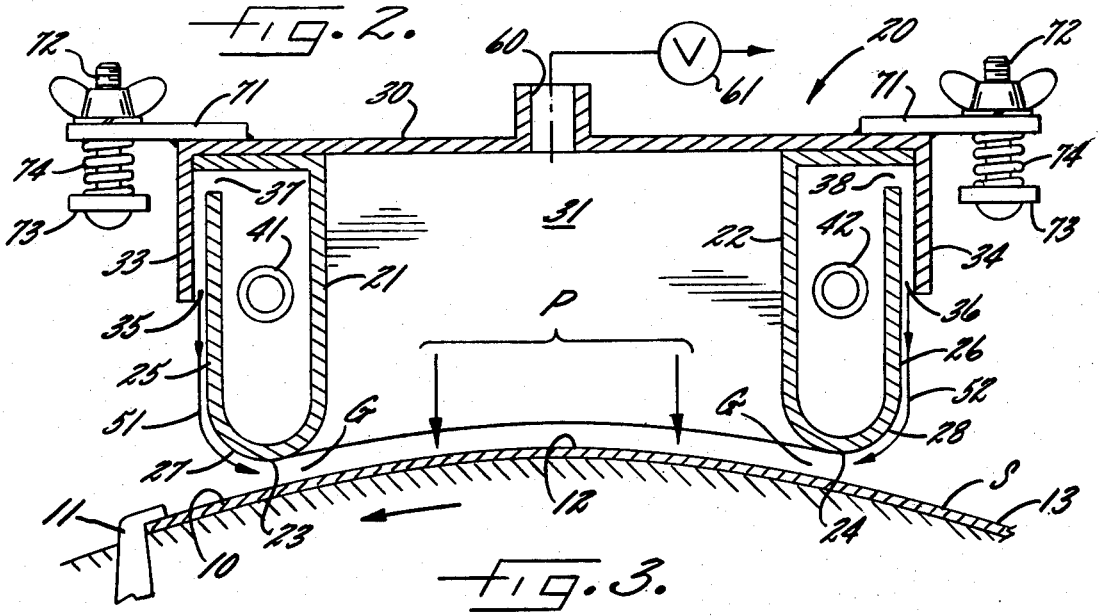
FIG. 3 shows an enlarged section of the device as viewed along line 3—3 in FIG. 2.

Turning to the exemplary device 20 set forth in FIGS. 2 and 3, the side walls of the box are formed by a pair of pipes 21, 22. The pipes are spaced parallel to one another and arranged in axially extending position above the cylinder so that the under surfaces of the pipes 23, 24 form a gap G which is of constant width.

The outer side walls of the pipes have flat upper portions 25, 26 and lower portions 27, 28 which are smoothly continuous therewith and which curve mutually inwardly.

Extending bridgingly between the pipes is a top wall 30 and end walls 31, 32 which, together with the pipes, form a box which acts as a plenum chamber adjacent the surface of the cylinder.

Arranged opposite, and parallel to, the flat portions 25, 26 of the pipes are skirts 33, 34, preferably formed integrally with the top wall 30 by bending down its lateral edges. The skirts define nozzles in the form of narrow slits 35, 36, respectively which extend continuously in the axial direction. The pipes are correspondingly slotted as indicated at 37, 38 to provide access to pressurized air in the pipes.

For the purpose of supplying air from a pressurized source 40 (see FIG. 2) air lines are provided in communication with inlet ports 41, 42 in the respective pipes.

In operation, with the impression cylinder rotating, and with the air pressure turned on, air from the pipes flows through the nozzles 35, 36 along the paths indicated by the arrows 51, 52. The air starts out in planar, generally radial, paths along the flat portions 25, 26 on the outer surfaces of the pipes. However, on striking the inwardly curved surfaces 27, 28, which are smoothly continuous therewith, the air, by reason of the Coanda effect tending to cling to the surface, is diverted inwardly in the direction of the gaps 23, 24, respectively, In short, the air tends to enter the gaps simultaneously from both sides, the effect of this being to build up a pressure head in the chamber which applies a force, indicated by the vectors P, which presses downwardly upon and which tends to spread a conveyed sheet evenly on the surface of the cylinder. Unlike the localized action of an impingeing air jet, pressure P is applied uniformly to the sheet over a relatively large area, progressively as the impression cylinder rotates. More important, however, is the fact that the direction of air flow acting upon the trailing edge of the sheet as it leaves the unit is in a direction to hold the trailing edge in its seated position. Note that the direction of the lower portion of arrow 51 is contrary to the direction of movement of the sheet. The present device is therefore to be contrasted with prior art operated seating arrangements where the applied air results in currents which overtake the trailing edge and tend to raise it from the cylinder.

In practicing the invention means including a restriction are provided for venting air from the chamber thereby to limit the pressure which is in the chamber and which is applied to the sheet. To some extent air is vented naturally under the lower edges of the end walls 31, 32 and, if desired, the clearance under such end walls may be reduced from that shown. However, we prefer to provide a vent opening 60 in the top wall 30 connected to an adjustable valve 61 providing an orifice of variable cross section, with the leakage rate determining the pressure P which is maintained within the chamber. The pressure required to provide orderly seating and spreading of the conveyed sheet can be optimized by visual observation. Moreover, if desired, pressure may be adjusted by varying the rate of air flow through the inlet lines 41, 42 by interposing at the outlet of the pressurized source a throttle valve or regulator valve (not shown).

Figure 4:
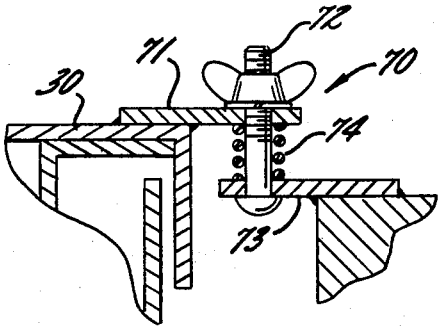
FIG. 4 is an enlarged section as viewed along line 4—4 in FIG 2, showing the means for adjusting the air gap between the device and the surface of the associated impression cylinder.

In accordance with one of the aspects of the invention means are provided for adjusting the gap G. This preferably is accomplished by employing an adjustable mount for the device, for example, as shown at 70 in FIG. 4. Such mount preferably includes a tongue 71 welded or otherwise secured to the top wall 30 which is connected, by means of an adjustable screw 72 to a bracket 73 on the press frame. The bracket and tongue are strongly biased away from one another by means of a coil spring 74 surrounding the screw. Such mechanism may be provided at each of the four corners of the device as indicated in FIG. 2. This enables the gap to be adjusted to precisely constant width. The actual width of the gap G may be optimized by observation, a matter within the skill of the art.

It will be apparent that the objects of the invention have been amply fulfilled. Unlike other arrangements employing air jets for seating and flutter control, no air currents are produced having the effect of raising the trailing edge of the sheet. Thus the sheet remains adherent to the surface of the cylinder even after departure of the sheet from the seating and spreading station.

While the seating and spreading assembly has been illustrated as being above the impression cylinder, it will be understood that the term "above" is simply a relative term employed for convenience and the device may be mounted at any angle to that shown without departing from the invention, depending upon the configuration of the cylinders in the press. And while the invention has been described and is particularly applicable to prevention of fluttering of sheets secured to an impression cylinder, it will be understood that the invention is equally applicable to any cylinder in a printing press or the like where a sheet is conveyed at high speed gripped only by the leading edge.

What is claimed is:

1. A device for seating and spreading a conveyed sheet evenly on an impression cylinder of a printing press thereby to prevent fluttering comprising a pair of pipes in spaced parallel relation to one another so as to present outer side walls, means for mounting the pipes in axially extending position above the cylinder, a source of pressurized air connected to the pipes, a top wall and end walls bridging the pipes and enclosing the space between them to form a plenum chamber adjacent the surface of the cylinder, the under surfaces of the pipes defining, with the surface of the cylinder, air gaps of constant width, the outer side walls of the pipes each having a substantially flat upper portion and an inwardly curved lower portion smoothly continuous therewith, each flat upper portion having a skirt arranged parallel thereto in overlapping relation to form a nozzle having an orifice in the shape of a narrow slit extending continuously along each pipe and in communication therewith so that pressurized air is directed radially inward along and parallel to each side wall with the air being diverted by the Coanda effect mutually inwardly into the air gaps for building up a pressure head in the chamber which pressses upon and tends to spread a conveyed sheet evenly and progressively on the surface of the cylinder, and means including a restriction for venting air from the chamber thereby to limit the pressure which is in the chamber and which is applied to the sheet.

2. A device for seating and spreading a conveyed sheet evenly on an impression cylinder of a printing press thereby to prevent fluttering comprising an elongated rectangular box having side walls, end walls and a top wall, the walls defining a plenum chamber, means for mounting the box in an axially extending position adjacent the surface of the impression cylinder so that the lower edges of the side walls define, with the surface of the cylinder, air gaps of constant width, the upper portions of the side walls being substantially flat and the lower portions of the side walls being smoothly continuous therewith and curved mutually inwardly in the direction of the chamber, the flat portions of the side walls each having a shirt spaced outwardly therefrom and parallel thereto to form respective nozzles each having an orifice in the shape of a continuous narrow slit, a source of pressurized air for feeding the nozzles so that the pressurized air is discharged radially inward along and parallel to the side walls, the air being diverted by the Coanda effect mutually inwardly following along the curved surfaces into the gaps at the lower edges of the side walls for building up a pressure head in the chamber which presses upon and tends to spread a conveyed sheet evenly and progressively on the surface of the cylinder, and means including a restriction for venting air from the chamber thereby to limit the pressure which is in the chamber and which is supplied to the sheet.

3. A device for seating and spreading a conveyed sheet evenly on an impression cylinder of a printing press thereby to prevent fluttering comprising an elongated rectangular box having side walls, end walls and a top wall, the walls defining a plenum chamber, means for mounting the box in an axially extending position adjacent the surface of the impression cylinder so that the lower edges of the side walls define, with the surface of the cylinder, air gaps of constant width, air jet nozzles at the outer surfaces of the respective side walls, means for conducting pressurized air to the nozzles, each of the nozzles being in the form of means defining a narrow slit extending continuously along the adjacent side wall for directing the pressurized air radially inward of the cylinder along and parallel to the side wall, the side walls being curved mutually inwardly in the region of their lower edges so that the pressurized air discharged along and parallel to the side walls is diverted by the Coanda effect so as to follow along the curved surfaces mutually inwardly into the gaps at the lower edges of the side walls for building up a pressure head in the chamber which presses upon and tends to spread a conveyed sheet evenly and progressively on the surface of the cylinder, and means including a restriction for venting air from the chamber thereby to limit the pressure which is in the chamber and which is applied to the sheet.

4. The combination as claimed in claim 1 or in claim 2 or in claim 3 in which the restriction is in the form of a vent valve having an orifice of variable cross section.

5. The combination as claimed in claim 1 or in claim 2 in which the skirts are formed integrally with the top wall.

6. The combination as claimed in claim 1 or in claim 2 or in claim 3 in which the mounting means is adjustable in a direction radially of the cylinder for varying the air gap.

* * * * *

UNITED STATES PATENT AND TRADEMARK OFFICE

CERTIFICATE OF CORRECTION

PATENT NO. : 4,384,524

DATED : May 24, 1983

INVENTOR(S) : Claus Simeth and Peter Mayer

It is certified that error appears in the above-identified patent and that said Letters Patent is hereby corrected as shown below:

Column 2, line 49, change "extending" to read --extend--.

Column 5, line 2, delete "shirt" and insert --skirt--.

Signed and Sealed this

*Twenty-third* Day of *August 1983*

[SEAL]

*Attest:*

GERALD J. MOSSINGHOFF

*Attesting Officer*

*Commissioner of Patents and Trademarks*